US005676580A

United States Patent [19]

Farrar

[11] Patent Number: 5,676,580

[45] Date of Patent: Oct. 14, 1997

[54] MODEL AIRPLANE AND KIT THEREFOR

[76] Inventor: Rodney Farrar, 11127 W. Dorado Pl., Littleton, Colo. 80127-1069

[21] Appl. No.: 489,805

[22] Filed: Jun. 12, 1995

[51] Int. Cl.[6] ..... A63H 27/18; A63H 33/00; H05B 3/00

[52] U.S. Cl. ..... 446/34; 446/86; 446/71; 219/233; 30/116

[58] Field of Search ..... 446/34, 86–88, 446/71; 219/233, 223, 240, 268; 30/116, 140; 83/171

[56] References Cited

U.S. PATENT DOCUMENTS

| | | | |
|---|---|---|---|
| 3,017,487 | 1/1962 | Priestly | 219/29 |
| 3,297,856 | 1/1967 | Gershon | 219/233 |
| 3,590,517 | 7/1971 | Regehr | 46/76 |
| 3,895,438 | 7/1975 | Burkepile et al. | 30/116 |
| 4,103,454 | 8/1978 | Stone | 46/79 |
| 4,108,181 | 8/1978 | Saliaris | 219/233 X |
| 4,345,401 | 8/1982 | Brzack | 446/61 X |
| 4,388,777 | 6/1983 | Hermann et al. | 46/79 |
| 4,895,541 | 1/1990 | Miller | 446/57 |

*Primary Examiner*—Mickey Yu
*Attorney, Agent, or Firm*—Daniel N. Lundeen

[57] ABSTRACT

A model airplane, airplane kit, method of making a model airplane, a plastic foam cutter useful for making the model airplane and a method for making the plastic foam cutter. The kit of the present invention enables children and adults to easily make a well flying model airplane using recycled plastic foam moldings such as polystyrene food trays well known as 10-S in the food packaging arts.

15 Claims, 3 Drawing Sheets

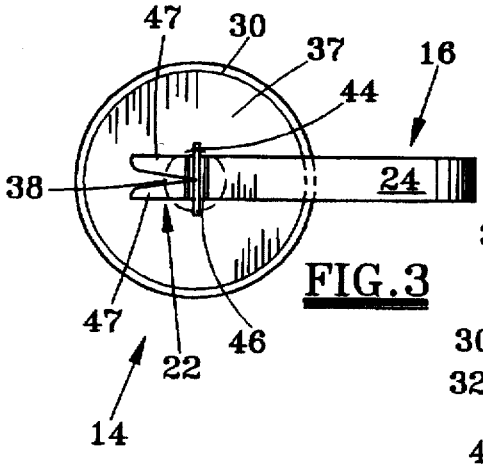
FIG.3
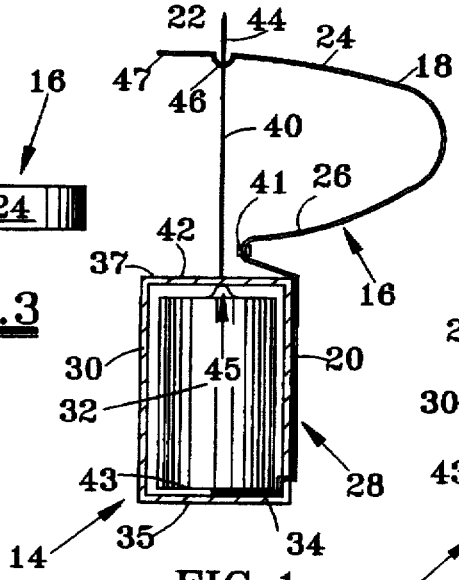
FIG.1
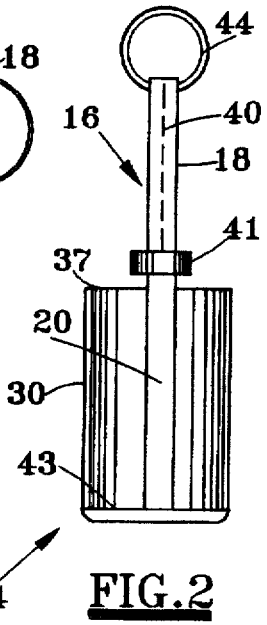
FIG.2
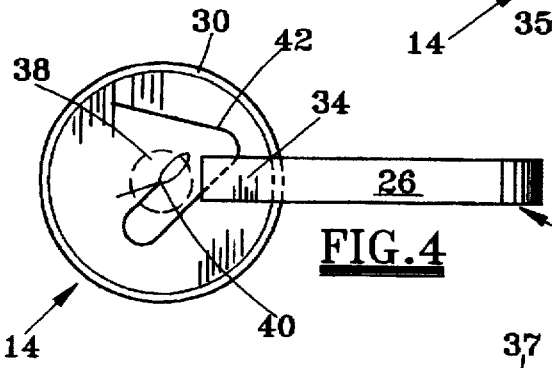
FIG.4
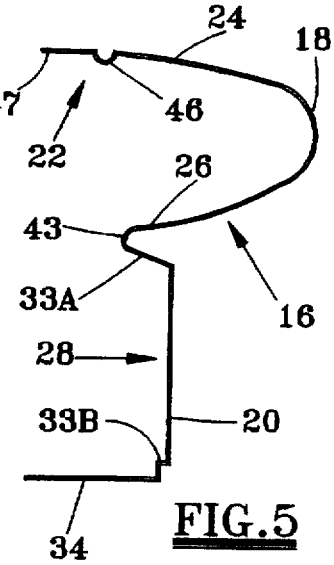
FIG.5
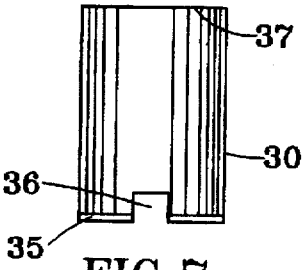
FIG.7
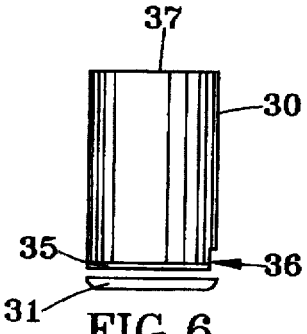
FIG.6
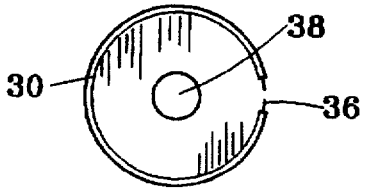
FIG.10
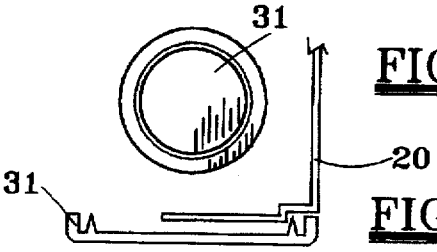
FIG.8
FIG.9

MODEL AIRPLANE AND KIT THEREFOR

FIELD OF THE INVENTION

The present invention relates to a model airplane and a kit for making the same. More particularly, the present invention relates to a model airplane constructed from a polystyrene foam food tray and an airplane making kit including a polystyrene cutter made from a camera film canister.

BACKGROUND OF THE INVENTION

Toy airplanes which fly through the air when thrown by hand are well known in the art. Among such toy airplanes designed to fly are model gliders constructed from balsa wood. U.S. Patents describing flying toy airplanes include U.S. Pat. No. 3,590,517 to Regehr; U.S. Pat. No. 4,895,541 to Miller; U.S. Pat. No. 4,103,454 to Stone; and U.S. Pat. No. 4,388,777 to Herman.

Plastic foam cutters employing a heated wire are also well known in the art. Such cutters are described in U.S. Pat. Nos. 3,895,438 to Burkepile et al.; 3,297,856 to Gershon; and 3,017,487 to Priestly.

Applicant is unaware of the prior use of polystyrene foam meat trays as a primary material for making a model airplane nor of a heated wire polystyrene foam cutter apparatus having a dual handle/battery holder made from an empty film canister.

SUMMARY OF THE INVENTION

The model airplane kit of the present invention includes a simple polystyrene foam cutter which permits even preteen children to build a well flying model airplane from food trays commonly used to display meat in a grocery store and generally discarded afterwards.

As one embodiment, the present invention provides an apparatus for cutting a plastic foam sheet. As one element, the foam cutter comprises a spring biased clip made from metal ribbon. The clip includes a straight section having an electrical contact end and a U-bend section having a hook end. As another element, a holder for a battery is provided. The holder is disposed at the straight section of the clip so that the electrical contact end is in electrical communication with a first pole of the battery and the holder doubles as a handle for the cutter. Also provided is a wire of relatively high electrical resistance. The wire extends from an aperture in the holder and is releasably held taut by the hook end of the U-bend section. The wire is attached to the holder by a metal member in electrical communication with a second pole of the battery so that an electrical circuit formed by the battery, clip and wire heats the wire. The cutter preferably includes a cover for securing the battery in the battery holder and attaching the clip to the battery holder.

As another embodiment, the present invention provides a method for making a plastic foam cutter. As a first step, a metal ribbon is bent into a clip having adjacent U-bend and straight sections. The straight section is offset from the axis to form an indented section for attachment of a battery holder. The battery holder is made by slotting a plastic film canister to receive the clip. The holder is secured in the clip indented section so that an electrical contact at a free end thereof is in electrical communication with one pole of a battery received in the holder. An electrically resistant wire is strung through an aperture formed in an opposite end of the holder for attachment under tension to a hook formed at a free end of the U-shaped section. The wire is secured in the holder by a metal member in electrical communication with a second pole of the battery, and an electrical circuit formed by the battery, clip and wire heats the wire to a suitable temperature to melt and cut the plastic foam.

As a further embodiment, the present invention provides a model airplane kit. The kit comprises a preformed plastic foam molding, the plastic foam cutter as mentioned above, a template for cutting wings from the plastic foam molding, sandpaper for sanding an airfoil on the wings, one or more weights for weighting a nose of the wing, an optional die for cutting wheels from the foam sheet, and an optional wire for attaching the wheels to the wing and forming a landing gear for the model airplane. The kit preferably comprises a polystyrene foam molding in the form of a 10-S food or meat tray commonly found in the grocery store. The kit preferably includes a template for making a sanding block from residual foam sheet.

As yet another embodiment, the present invention provides a method of making a model airplane. As a first step, an airplane wing template is removably secured to a preformed plastic foam molding. As a second step, the wing is cut from the foam molding by passing the hot wire of the foam cutter described above along an edge of the template. An airfoil is then sanded on the wing. Weights are attached to a nose of the wing. Wheels are preferably cut from the foam molding, attached to a wire and secured to the wings to form a landing gear. The wing cutting step preferably includes the step of latching the cutting wire to the U-bend hook to complete the circuit with the battery and heat the wire. The plastic foam molding preferably comprises a polystyrene 10-S food or meat tray commonly found in the grocery store. The wheels are preferably cut from the foam using a tubular die.

As yet a further embodiment, the present invention provides a model airplane made by the steps of: securing a wing template against a preformed plastic foam molding; cutting the wing from the foam molding using the foam cutter described above; sanding an airfoil on the wing; attaching weights to a nose of the wing; and making a landing gear for attachment to an underside of the wing by cutting wheels from the foam molding, attaching the wheels to a wire and securing the wire to the wings. The plastic foam molding preferably comprises a polystyrene 10-S food or meat tray commonly found in the grocery store. The wheels are preferably cut from the foam molding using a tubular die.

BRIEF DESCRIPTION OF THE DRAWINGS

FIG. 1 is a side view, partly in section, of a hot wire polystyrene foam cutter of the present invention.

FIG. 2 is a side perspective view of the cutter of FIG. 1 rotated clockwise by 90 degrees.

FIG. 3 is a top view of the cutter of FIG. 1.

FIG. 4 is a bottom view of the cutter of FIG. 1 without the battery showing the inside of the battery holder.

FIG. 5 is a side view of a metal ribbon shaped to form the body of the cutter of FIG. 1.

FIG. 6 is a side view of a battery holder and cap (disengaged) for the polystyrene foam cutter of the present invention showing a slot 36 in an open end thereof.

FIG. 7 is a side view of the holder of FIG. 6 rotated clockwise by 90 degrees to show the slot 36.

FIG. 8 is an inside planar view of a battery holder cap.

FIG. 9 is a cross-sectional view of the cap of FIG. 8 profiled with the metal ribbon.

FIG. 10 is a bottom view of the holder of FIG. 6 showing the aperture at a closed end and the slot in the open end.

DETAILED DESCRIPTION OF THE INVENTION

Figure 11:
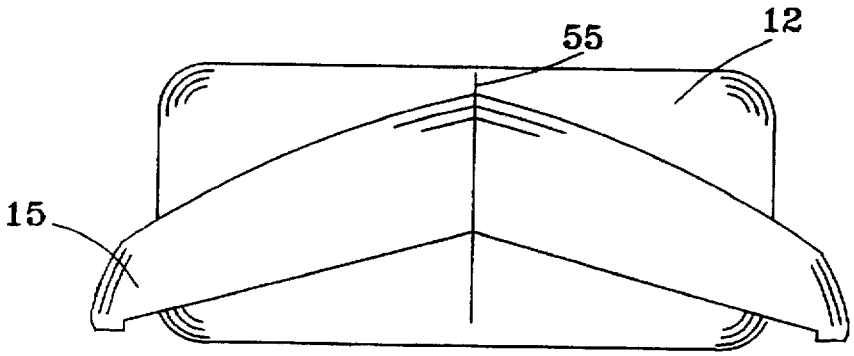
FIG. 11 is a top planar view of a 10-S style polystyrene foam meat tray having a template of a model airplane wing of the present invention secured thereto.

Recycled materials including old film canisters and disposable Styrofoam meat trays are used to build a well flying model airplane for the amusement of both children and adults.

Referring to FIGS. 1–17, a model airplane 10 which can supply long lasting enjoyment for children and adults is cut from a preformed molding of plastic foam 12 using a foam cutter 14 and a wing template 15 for tracing the wing pattern on the foam molding 12. In the practice of the present invention, the plastic foam molding 12 preferably comprises a size 10-S meat or food tray made of polystyrene foam.

The foam cutter 14 comprises a clip 16 bent from a metal ribbon into an adjacent U-bend section 18 and a straight section 20. The U-bend section includes a free end having a hook 22. Legs 24, 26 of the U-bend section 18 are tensioned when drawn together.

The straight section 20 is made to define an indented section 28 offset from the clip axis for receiving a holder 30 for a battery 32. The indent section 28 has upper and lower sides 33*a*, 33*b* formed by bending the ribbon. In the practice of the present invention, the holder 30 preferably comprises a plastic 35 mm film canister having dimensions well known in the art. The canister 30 which includes a cap 31 has an ideal size for holding a C-cell type battery.

A free end of the straight section 20 is shaped to define an electrical contact 34 for one pole of the battery 32. The canister 30 has a slot 36 formed in an open end 35 thereof for receiving the contact end 34. Covering the canister 30 with the cap 31 secures the placement of the battery 32 and retains the free end of the straight section 20 of the clip 16 therein.

A closed end 37 of the canister 30 has an aperture 38 through which a cutting wire 40 tautly extends. The cutting wire 40 has sufficient electrical resistance for heating by a suitable electric current. One end of a cutting wire 40 is secured inside the canister by a metal member 42 (see FIGS. 1 and 4). The other end of the wire is secured to a metal member 44 for attachment under tension at the hook end 22 of the U-bend section 18 (see FIGS. 1 and 3). With the wire held taut and the canister cap 31 engaged, the canister 30 is securely held within the indent section 28 of the clip 16 to form a handle therefor. A rubber band 43 stretched around the canister open end 35 with the clip electrical contact end 34 received therein (see FIGS. 1 and 2) can be optionally used to assist the assembly of the foam cutter 12 prior to engagement of the cap 31.

The metal member 42 preferably comprises a metal paper clip which provides an electrical contact for a second pole 45 of the battery 32 (see FIG. 1). The metal member 44 preferably comprises a ring releasably received by a seat 46 formed in the hook 22 (see FIGS. 1 and 3). Each end of the cutting wire 40 is preferably looped around the metal members 42, 44 in a secure fashion so that the wire 40 can extend tautly from the canister 30 by hooking the ring member 44 in the seat 46 (see FIGS. 1–3). The hook 22 is preferably shaped in the form of prongs 47 to permit the wire to pass therebetween for seating the ring 44 (see FIG. 3).

It can be seen that spring tension existing in the U-bend section 18 of the clip 16 provides a force suitable for maintaining the cutting wire 40 in taut extension. By securing the wire 40 to the hook end 22 of the U-bend section 18, a completed electrical circuit defined by the clip 16, the battery 30 and the wire 40 is formed in which instance an electric current from the battery heats the wire 40. The clip 16 preferably has an insulating grommet 41 at a neck section 43 closest to the wire 40 to inhibit short-circuiting the wire 40 at the neck section 43.

It can further be seen that the cutter 14 can be simply engaged or disengaged as a switch for current flow and wire heating by seating and unseating the ring member 44 from the hook seat 46. To switch the cutter on and off, one can grasp and slightly compress the U-bend portion of the clip 16, to allow the ring 44 to be seated and/or unseated in the hook 22.

The model airplane 10 of the present invention has a wing 48 which includes a swept back span 50 and raised tips or winglets 52 at either end thereof. The wing 48 is made by securing the template 15 to the flat surface of the polystyrene tray 12, e.g. by using double-sided adhesive tape between the template 15 and the tray 12. As best seen in FIG. 11, tip tabs of the template 15 are aligned with a long side 57 of the tray 12, and a nose 51 of the wing 48 is aligned with a centerline 55 of the tray. The wing 48 is then obtained by passing the hot wire 40 of the cutter 14 through the tray against the perimeter of the template 15. After the wing 48 is cut from the tray, the template 15 is removed and can be used again for making more of the wings 48.

Figure 12:
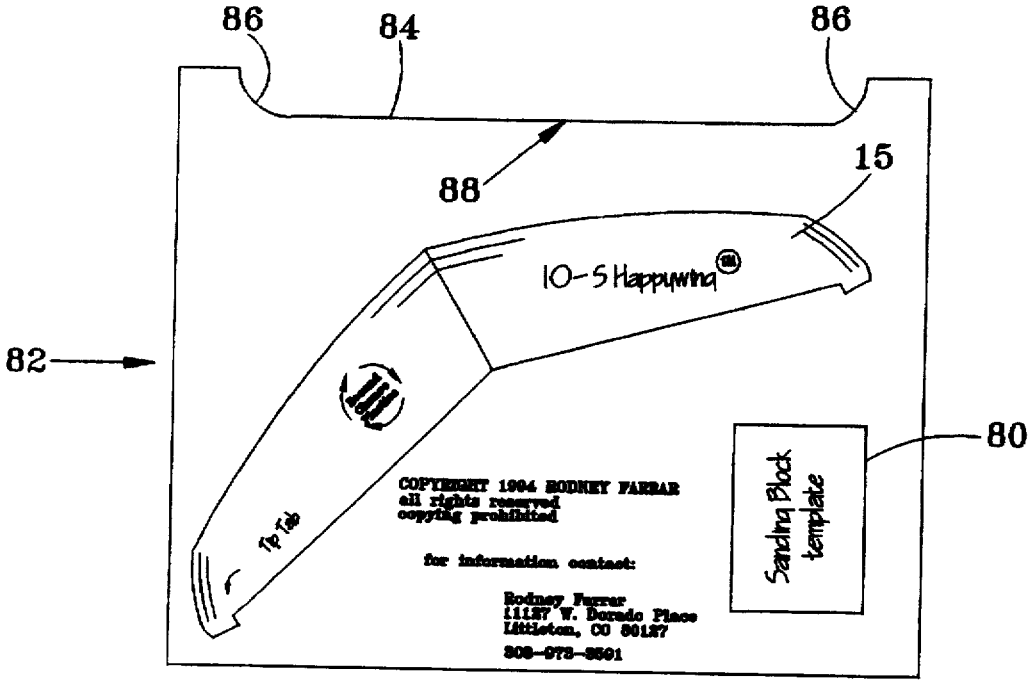
FIG. 12 is a view of a template for centering and cutting a model airplane wing on the polystyrene meat tray.
Figure 13:
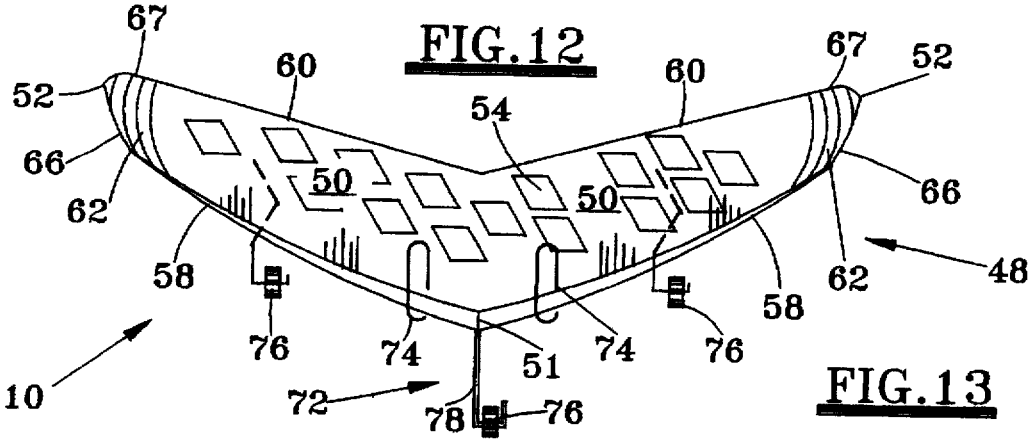
FIG. 13 is a top view of an assembled model airplane of the present invention having an airfoil sanded at a wing top side leading and trailing edges.
Figure 14:
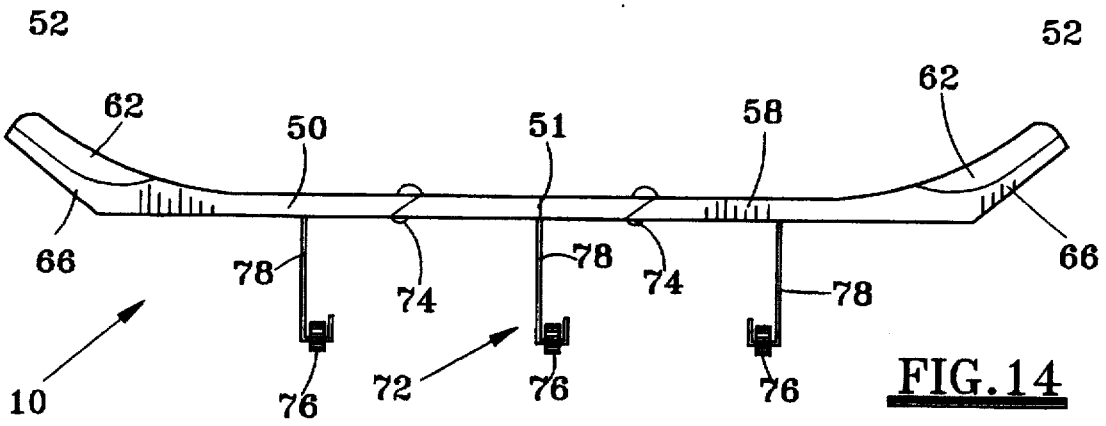
FIG. 14 is a frontal view of the model airplane of FIG. 13 showing the raised tips of the wing.
Figure 15:
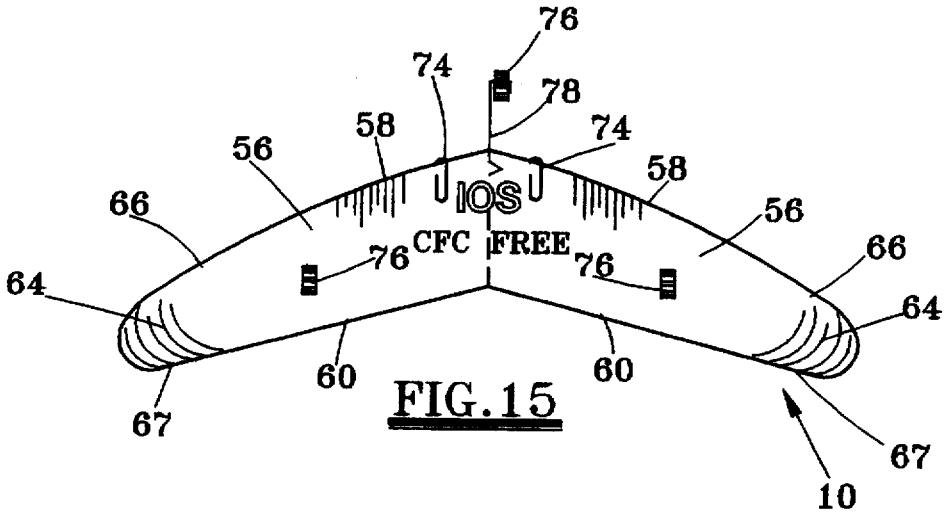
FIG. 15 is a bottom view of the model airplane of FIG. 13.

The template 15 can be a paper or cardboard form, desirably cut from a pre-printed sheet 82 (see FIG. 12). The sheet 82 can also include a sanding block template 80, and a centerline locating aid 84 formed on one end thereof. The centerline locating aid 84 has a profile with curved ends 86 corresponding to the size and profile of a 10-S tray and a centerline indicator 88 corresponding to the exact middle of the tray 12. The centerline 55 is located by placing the indicator aid 84 against the tray 12 with the curved ends 86 adjacent respective ends of the tray 12, and noting the position of the centerline indicator 88. Great care is taken in the positioning of the template 15 with the nose 51 aligned with the centerline 55 since this is critical for the proper flight characteristics.

The winglets 52 of the wing 48 are formed by the upturned edges of the foam tray 12. The span portion 50 defines respective top and bottom planar surfaces 54, 56 and respective leading and trailing edges 58, 60. The winglets 52 define planar side surfaces 62, 64 and leading and trailing edges 66, 67.

Figure 16:
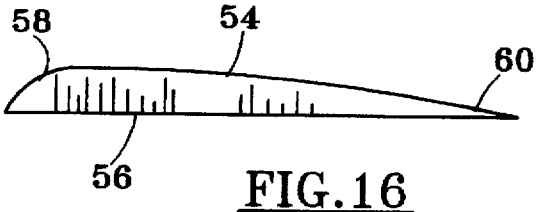
FIG. 16 is a vertical cross-sectional view of the wing span showing the particular shape of the airfoil at the wing leading and trailing edges.
Figure 17:
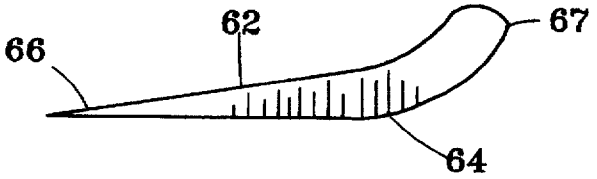
FIG. 17 is a horizontal cross-section view of the wing tip.

As seen in FIG. 16, the span 50 has an airfoil shape. The airfoil is preferably produced by lightly sanding the span top surface 54 at the leading and trailing edges 58, 60 in an acceptable fashion. The span bottom surface 56 is generally not altered. An aerodynamically stable cross-section (see FIG. 17) is formed in the winglets 52 by sanding the planar side surfaces 62, 64 at the leading edge 66 thereof. A sanding block (not shown) can be conveniently made from a residual section of the tray 12 by tracing a block shape thereon using a block template 80, for example, and cutting along the traced lines using the foam cutter 14.

Following the aerodynamic shaping of the wing 48, the airplane is completed by weighting the nose 51 and attaching a landing gear 72. The nose 51 can be conveniently weighted by a pair of paper clips 74 on either side thereof which are then adjusted fore and aft for best flight characteristics. In addition, the wing 48 can be further sanded to fine tune the glide characteristics. For example, if the wing 48 turns right, sanding off a slight portion of the reflex surface adjacent the right winglet 52 can correct the turning tendency.

The landing gear 75 can be made of polystyrene foam wheels 76 of an appropriate size attached to the bottom surface 56 of the wing 48 by steel wires 78 bent to an accommodating shape. The wires 78 can be attached to the wing 48 by adhesive tape. The wheels 76 are conveniently cut from an unused residual portion of the polystyrene sheet 12 preferably using a die (not shown) comprising a piece of thin walled ⅜ inch tubing.

In addition, the underside 56 of the wing 48 can include a launching tab (not shown) so that the plane can be launched by gripping the tab (not shown).

The airplane 10 is launched by holding it above one's head with the wing 48 level, moving the airplane 10 forward through the air and releasing with the nose 51 falling forward. Throwing too hard causes nose-up and stalls; left wingtip low creates a left-turning flight, and likewise with the right tip low. A hard downward throw with the wingtips level can cause a loop; hard throws to the left or right can cause a boomerang flight path.

A kit for making the model airplane 10 preferably comprises one or more 10-S polystyrene trays 12, the polystyrene foam cutter 14, the template sheet 82 and written instructions (not shown) for putting the whole thing together. In addition, the kit can include a spool of high gauge steel wire (not shown), an extra ring member 44, and optionally the tubular wheel die (not shown). Suitable wire comprises high pitch guitar wire.

In addition, one or more of associated building materials can be included although such materials are generally found in most households. Among associated building materials are paper clip nose weights 74, sandpaper (not shown), adhesive tape (not shown), and a C-cell battery 32.

The present model airplane and kit therefor is illustrated by way of the foregoing description and examples. The foregoing description is intended as a non-limiting illustration, since many variations will become apparent to those skilled in the art in view thereof. It is intended that all such variations within the scope and spirit of the appended claims be embraced thereby.

What is claimed is:

1. An apparatus for cutting a model airplane from a plastic foam sheet comprising:

a spring biased clip made from metal ribbon, the clip including a straight section having an electrical contact end and a U-bend section having a hook end;

a holder having a battery disposed therein, the holder received by the straight section of the clip so that the electrical contact has electrical communication with a first pole of the battery and the holder forms a handle for the cutter; and a wire of relatively high electrical resistance extending from an aperture in the holder to a ring tautly held by the hook end of the U-bend section, wherein the wire is attached to the holder by a metal member in electrical communication with a second pole of the battery so that an electrical circuit formed by the battery, clip, ring and wire heats the wire, and wherein the electrical circuit is interruptable by compressing the U-bend section of the clip to release the ring from the hook end of the U-bend section.

2. The cutter apparatus of claim 1 including a cover for securing the battery in the battery holder and attaching the battery holder to the clip.

3. A method of making a plastic foam cutter comprising the steps of:

bending a metal ribbon into a clip having adjacent U-bend and straight sections, the straight section offset from a longitudinal axis to form an indented section for attachment of a battery holder;

slotting an open end of a plastic film canister to receive a free end of the indented section to form the battery holder;

securing the battery holder in the clip indented section so that an electrical contact at the free end thereof is in electrical communication with one pole of a battery received in the holder;

stringing an electrically resistant wire through an aperture in the holder for attachment under tension to a hook formed at a free end of the U-shaped section, wherein the wire is secured in the holder by a metal member in electrical communication with a second pole of the battery and an electrical circuit formed by the battery, clip and wire heats the wire.

4. A model airplane kit comprising:

a preformed plastic foam molding;

the plastic foam cutter of claim 1;

a template for cutting an airplane wing from the plastic foam molding;

sandpaper for sanding an airfoil in the wing;

one or more weights for weighting a nose of the wing;

an optional die for cutting wheels from the foam molding;

wire for attaching wheels to the wings and forming a landing gear for the model airplane.

5. The kit of claim 4, wherein the plastic foam comprises polystyrene.

6. The kit of claim 5, wherein the polystyrene molding comprises a food tray.

7. The kit of claim 6, wherein the polystyrene food tray has physical dimensions of a size 10-S tray.

8. The kit of claim 4, including a template for making a sanding block from residual foam molding.

9. A method for making a model airplane comprising the steps of:

removably securing a wing template on a plastic foam molding;

cutting a wing from the foam molding using the foam cutter of claim 1;

sanding an airfoil on the wing;

attaching weights to a nose of the wing;

cutting wheels from the foam molding, attaching the wheels to a wire and securing the wire to the wing to form landing gear for the model airplane.

10. The method of claim 9, wherein the wing cutting step includes the step of latching the cutting wire to the U-bend hook to complete the circuit with the battery and heat the wire.

11. The method of claim 10, wherein the plastic foam comprises polystyrene.

12. The method of claim 11, wherein the polystyrene molding comprises a food tray.

13. The method of claim 12, wherein the polystyrene food tray has physical dimensions of a size 10-S tray.

14. The method of claim 9, wherein the wheels are cut using a die comprising a piece of thin walled tubing of suitable diameter.

15. A model airplane made by the method of claim 10.

* * * * *